US005929411A

United States Patent [19]

Schulman

[11] Patent Number: 5,929,411

[45] Date of Patent: Jul. 27, 1999

[54] VAPOR SHIELD FOR VACUUM INTERRUPTERS

[75] Inventor: Michael Bruce Schulman, Ithaca, N.Y.

[73] Assignee: Eaton Corporation, Cleveland, Ohio

[21] Appl. No.: 08/955,944

[22] Filed: Oct. 22, 1997

[51] Int. Cl.[6] ..... H01H 33/66

[52] U.S. Cl. ..... 218/136; 218/139

[58] Field of Search ..... 218/118, 121, 218/123, 134, 135–139

[56] References Cited

U.S. PATENT DOCUMENTS

| | | | |
|---|---|---|---|
| 4,553,007 | 11/1985 | Wayland | 200/144 B |
| 5,444,201 | 8/1995 | Schulman et al. | 218/118 |
| 5,691,522 | 11/1997 | Schulman et al. | 218/128 |

OTHER PUBLICATIONS

*High Voltage Vacuum Insulation: Basic Concepts and Technical Practice,* edited by R.V. Latham, Academic Press, New York, pp. 166, 167, 180, 181, 184, 185, 188–199, 202–204, 220, 221, 228–251, 257–261, 282–285, 295–297, 516, 517, 549–551, 555 and 558–560 (1995).

*Primary Examiner*—Michael A. Friedhofer
*Attorney, Agent, or Firm*—Martin J. Moran

[57] ABSTRACT

A vacuum interrupter (VI) is provided having two arcing contacts, at least one of which is axially moveable, and a metal-vapor condensing shield which is shaped to allow the VI to withstand a high peak value of pulsed or sinusoidal high voltage applied to the cold contacts in their open position. In the region surrounding the open contacts, the vapor shield is shaped to deflect the trajectories of electrons which are emitted from the regions of high electric field stress along the facing edges of the negatively biased contact. The vapor shield causes electrons to be substantially deflected away from the intercontact edge region and onto a defocused area of lower electric field stress on the shield.

17 Claims, 5 Drawing Sheets

VAPOR SHIELD FOR VACUUM INTERRUPTERS

FIELD OF THE INVENTION

The present invention relates to vacuum interrupters, and more particularly to vapor shields for use in vacuum interrupters.

BACKGROUND INFORMATION

Vacuum interrupters (VIs) are typically used to interrupt medium to high voltage AC currents. For example, VIs may be used to interrupt or switch AC currents of up to several tens of kiloamperes, in medium to high voltage circuits which include reactive elements and loads. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit.

A metal-vapor arc is typically formed between the contact surfaces when the contacts are moved apart to the open circuit position while current is flowing through the VI. The arcing continues until the current is interrupted. Metal vapor which is produced from the contacts during the arcing condenses back onto the contacts and also onto vapor shields placed between the contact assemblies and the vacuum envelope after the current is extinguished.

Many applications require the VI to withstand a power-frequency (AC) voltage (typically>100 kV RMS), or a basic impulse level (BIL) voltage (typically>200 kV peak), which is impressed across its open contacts. The voltage withstand ability is in general the highest level of applied voltage at which the VI will reliably not suffer an internal breakdown of the cold vacuum gap, with a specified separation between the contacts and a specified waveform of the applied voltage (AC or BIL). Many applications also require the VI to withstand a transient recovery voltage in order to achieve interruption of high-current arcs.

SUMMARY OF THE INVENTION

The present invention provides a vacuum interrupter vapor condensing shield which is shaped to allow the VI to withstand a high peak value of pulsed or sinusoidal high voltage applied to the VI contacts in their open position. In the region adjacent the open contacts, the vapor shield is shaped to deflect the trajectories of electrons which are emitted from regions of high electric field stress on the cathode. The vapor shield causes electrons to be deflected away from the anode onto a defocused area of lower electric field stress on the vapor shield, thereby allowing the vacuum interrupter to withstand a high voltage.

An object of the present invention is to provide an improved vacuum interrupter vapor shield.

Another object of the present invention is to provide a vacuum interrupter including a sealed vacuum envelope, electrodes inside the vacuum envelope which are separable to form a contact gap, and a vapor shield between the vacuum envelope and the electrodes, wherein the vapor shield includes an extended portion adjacent to the contact gap extending toward the gap.

Another object of the present invention is to provide a vapor shield for a vacuum interrupter including a substantially cylindrical body having end and middle portions, and an annular bump extending radially inward from the middle portion of the substantially cylindrical body.

These and other objects of the present invention will be more apparent from the following description.

DESCRIPTION OF THE PREFERRED EMBODIMENTS

Figure 1:
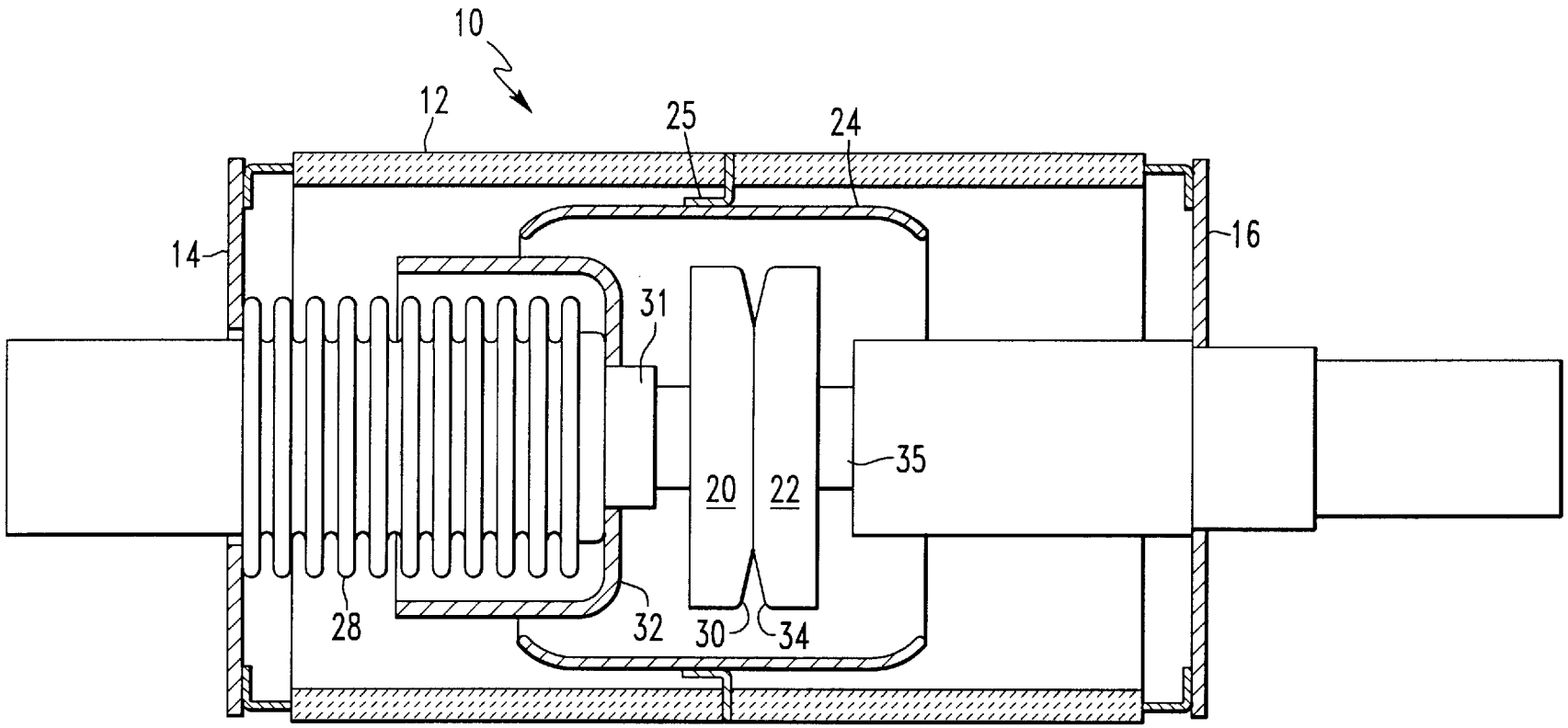
FIG. 1 PRIOR ART
FIG. 1 is a sectional view of a vacuum interrupter including a conventional vapor shield.

FIG. 1 shows a typical prior art vacuum interrupter 10 including a cylindrical insulating tube 12 and end plates 14 and 16. Electrode assemblies 20 and 22 are longitudinally aligned within a vacuum envelope formed by the insulating tube 12 and end plates 14 and 16. A generally cylindrical vapor shield 24 surrounds the electrode assemblies 20 and 22 to prevent metal vapors from collecting on the insulating tube 12. In this embodiment, a support flange 25 secures the vapor shield 24 between separate upper and lower halves of the insulating tube 12. In the configuration shown, the vapor shield 24 is electrically isolated from the electrode assemblies 20 and 22.

The electrode assemblies 20 and 22 are axially movable with respect to each other for opening and closing the AC circuit. A bellows 28 mounted on the electrode assembly 20 seals the interior of the vacuum envelope formed by the insulating tube 12 and end plates 14 and 16, while permitting movement of the electrode assembly 20 from a closed position as shown in FIG. 1 to an open circuit position (not shown). The electrode assembly 20 includes an electrode contact 30 connected to a generally cylindrical terminal post 31 which extends out of the vacuum envelope through a hole in the end plate 14. A cup-shaped shield 32 is mounted on the terminal post 31 in order to keep metal vapors off the bellows 28. Likewise, the electrode assembly 22 includes an electrode contact 34 connected to a generally cylindrical terminal post 35 which extends through the end plate 16. Additional shields (not shown) can be included to further protect the end regions of the insulating tube 12 from metal vapors, as is known in the art.

Conventional VIs such as shown in FIG. 1 have less than optimal voltage withstand ability. The internal conditions and parameters of a VI which influence its voltage withstand ability can generally be categorized as microscopic or macroscopic. At the microscopic level, the mechanisms of breakdown due to BIL versus AC voltages are different, but for both types of voltage waveforms the two general microscopic effects which are most important in breakdown are electron emission and production of microparticles. Breakdown can be initiated by one of these effects alone, or by a combination and interaction of the two, as is explained in the book *High Voltage Vacuum Insulation: Basic Concepts and Technical Practice*, edited by R. V. Latham, Academic Press, New York (1995).

One BIL breakdown mechanism is non-explosive field emission. In this case, an electron beam is produced from a microscopic feature on the cathode surface which is subject to a high local electric field. If this beam impinges on a small spot on the anode, the spot on the anode can be rapidly melted from the high heat flux. Microparticles may also be rapidly pulled from the anode hot spot or the cathode emitting point. Microparticle induced breakdown can result from impact initiation, detachment triggering, or vaporization of the microparticle by the electron beam. A more rapid BIL breakdown can result from explosive electron emission from microscopic sites on the cathode. The exploding plasma which follows is known as a cathode flare. This explosive emission can also be initiated by the high field around charged foreign particles on the surface. A breakdown may result from the cathode flare alone, or may be triggered when the increasing power density in the anode spot results in an anode flare.

On the macroscopic level, the voltage at which breakdown occurs between the contacts may be influenced by the geometry of the contacts and the vapor condensing shield. Finite element analysis calculations can accurately determine the macroscopic steady-state electric field throughout the VI for given internal geometries. With a conventional electrically floating vapor shield, the equipotential lines wrap around the corners of both contacts in their open position. The two contacts experience enhanced field stress at the periphery of their facing structures. In particular, BIL breakdown is initiated by emission of an electron beam or flare from the negatively biased contact or cathode, with this emission preferentially originating from the region of highest geometric electric field stress.

Figure 2:
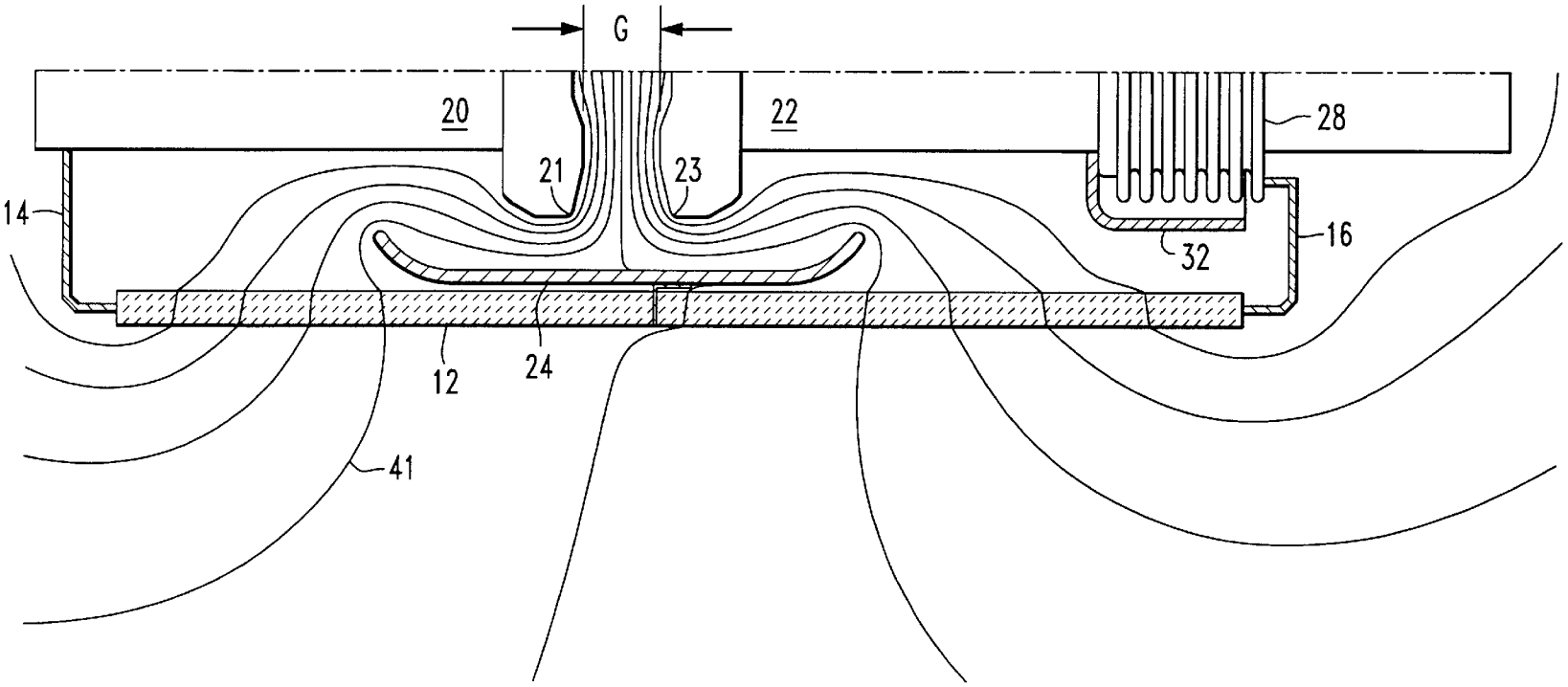
FIG. 2 PRIOR ART
FIG. 2 is a partial sectional view of a conventional vacuum interrupter assembly showing equipotential lines which wrap around the corners of the open contacts.

FIG. 2 is an axisymmetric sectional view of a VI with an electrically floating vapor shield typical of the prior art. The conventional vapor shield 24 is characterized by its flat or fixed-radius inner surface in the region of the contact gap G. Equipotential lines 41 wrap around the corners of the open contacts. The cathodic 20 and anodic 22 electrode assemblies experience enhanced field stress at the periphery of their facing structures near the corners 21 and 23 of the contacts. In particular, BIL breakdown may be initiated by emission of an electron beam or flare from the negatively biased electrode assembly 20, with the emission preferentially originating from the region of highest geometric electric field stress 21. While reference is made herein to "anode" and "cathode" contacts, it will be understood that this identification of elements is used for convenience of expression only, and that the functional role of anode and cathode will alternate between the two contacts with the alternating polarity of the applied voltage to the vacuum interrupter.

However, in the presence of anodic involvement in the breakdown, the BIL breakdown level depends not only on the highest magnitude of geometric electric field stress on the cathode 20, but also on how the electron beam or cathode flare deposits its energy by bombarding on the anode 22. In the prior art, the majority of the electrons, with the possible exception of the highest energy electrons in the tail of the velocity distribution, will closely follow electric field lines, which are perpendicular to the equipotential lines 41, from the cathodic micro-emitter to the anode.

Figure 3:
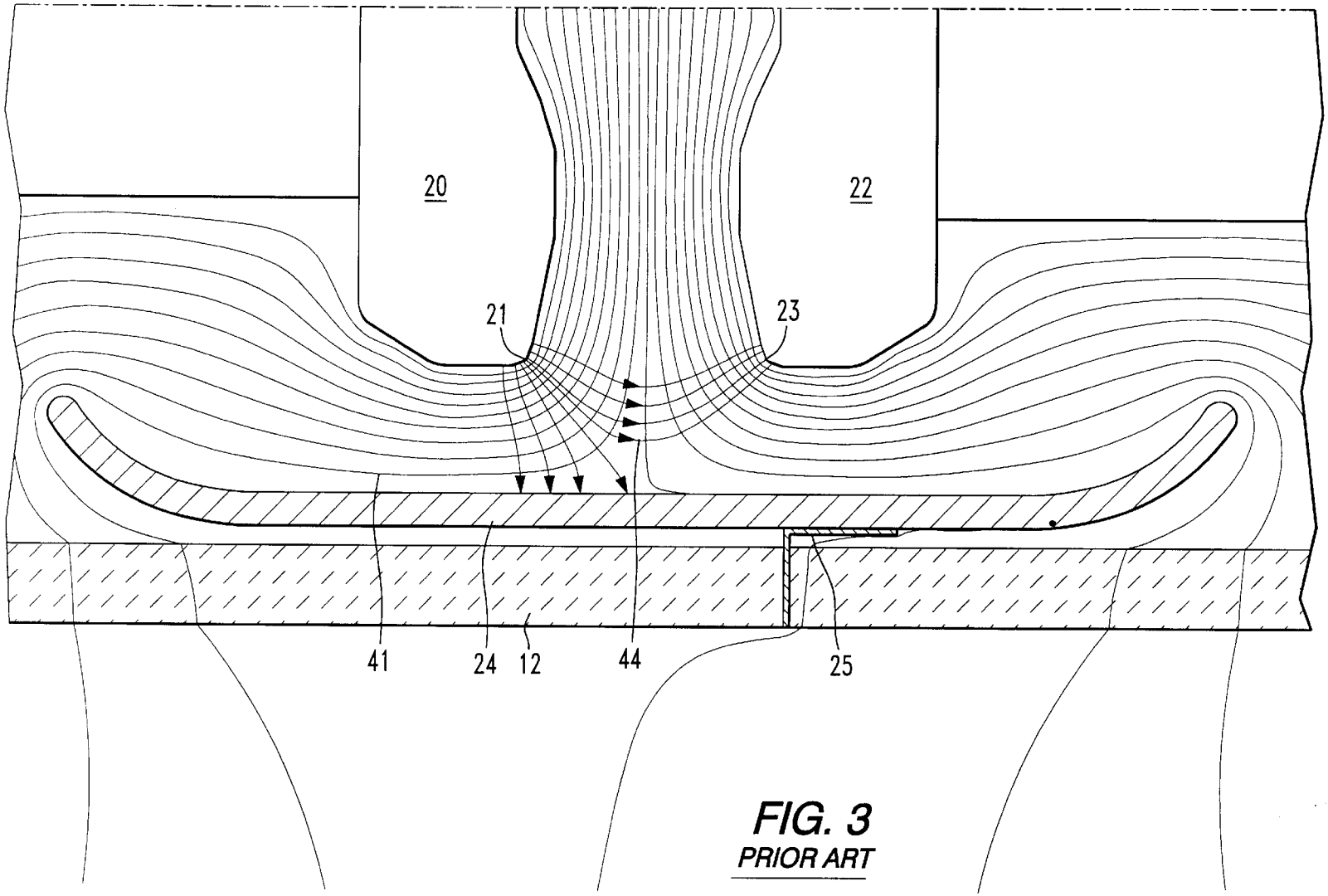
FIG. 3 PRIOR ART
FIG. 3 is an enlarged view of the conventional vacuum interrupter assembly of FIG. 2, showing more equipotential lines, and selected lines of force which start on the corner of the cathode contact, which is a region of enhanced electric field stress. In the configuration illustrated, some of these lines of force from the cathode connect back to the opposing corner of the anode, and others connect to the vapor shield.

FIG. 3 shows more equipotential lines 41 for the conventional design of FIG. 2, with the lines of force 44 shown originating from the corner of the cathode contact 21. The lines of force 44, which map the direction of the electric field, run perpendicular to the equipotential lines 41. An electron beam emitted from the high field portion 21 of the cathode contact 20 can follow the lines of force 44 which connect back to the opposing contact 22 in a tightly focused spot. This can readily produce a hot spot on the anode 22 at its region of highest electric field stress 23. Therefore, breakdown can occur at lower than expected field stress on the cathode 20.

FIG. 3 also shows that from the portion of the corner 21 of the cathode contact 20 which faces more toward the shield 24, the field lines diverge towards a large area on the shield 24. If an electron beam were emitted from this portion of the corner 21, it would strike the isolated shield, and would be accelerated through only about half of the applied voltage, since the shield is electrically floating in this embodiment. Therefore, it would produce only a small heat load per unit area on the shield 24.

In accordance with the present invention, for contacts of a given diameter and specified gap, a higher withstand voltage can be obtained if the vapor shield is designed to deflect an emitted electron beam which originates from the highly electrically stressed edge of a contact away from the opposing contact and onto a defocused area on the shield. The present invention provides a VI having enhanced ability to hold off high electric field stress, for example, on the corner of the cathode contact, by a shield which produces greater fringing of the lines of force away from the gap and toward the shield. This diverts and defocuses the electron beams which leave from the emitting sites on the highly stressed contact corner.

As used herein, the term "contact gap" means the gap that is formed when the contacts are in the fully open position. The full gap G is usually set by adjusting the stroke of an attached external switching mechanism (not shown), and is typically about 6 to 24 mm, depending on the size of the VI and the application it is used for.

Figure 4:
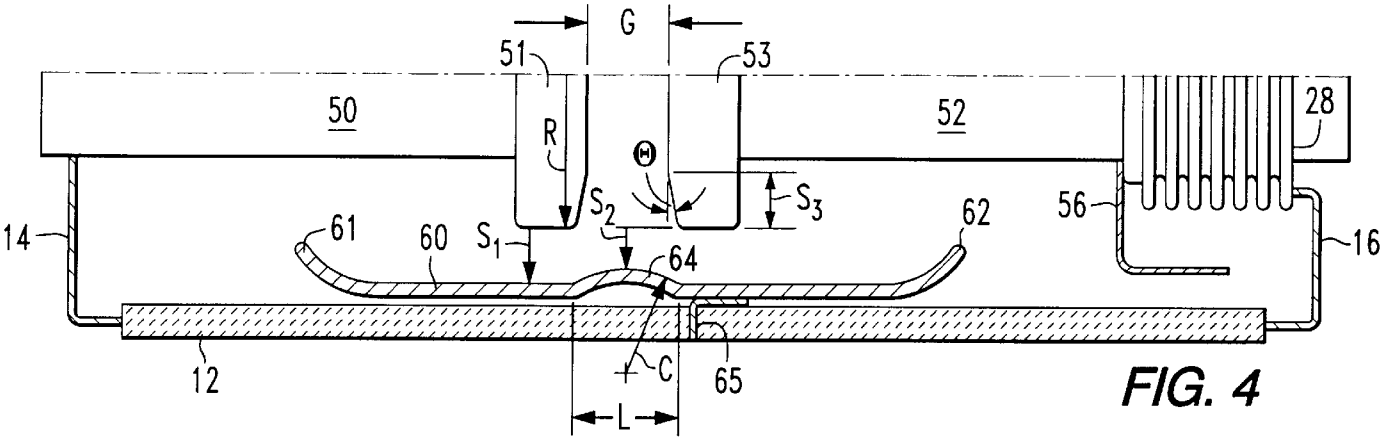
FIG. 4 is a partial sectional view of a vacuum interrupter including a vapor shield in accordance with an embodiment of the present invention.

FIG. 4 shows one embodiment of a vacuum interrupter vapor shield of the present invention used in association with electrode assemblies 50 and 52, with disk-shaped contacts 51 and 53 in the fully open position to form a contact gap G. The vacuum interrupter includes an insulating tube 12 and end plates 14 and 16. The movable electrode assembly 52 includes a bellows shield 56. The substantially cylindrical vapor shield 60 preferably includes end sections 61 and 62 which curve radially inward, and an extended electrically conductive annular bump 64 toward the middle of the vapor shield 60. The vapor shield 60 is attached to a flange 65, which is typically attached between two sections of the insulating tube 12 using a vacuum sealing braze method, as is known in the art. Alternatively, one end of the vapor shield 60 may be electrically connected to one of the electrode assemblies.

In the embodiment of FIG. 4, the shield 60 is preferably made from a thin cylinder of an appropriate vacuum compatible metal such as stainless steel or copper. In the region of the contact gap G, the inner surface of the shield 60 smoothly curves inward to form the annular bump 64. The extended annular bump 64 is preferably positioned axially so that in the region of the gap G its position of minimum radius coincides, or nearly coincides, with the midplane of the gap G.

Figure 5:
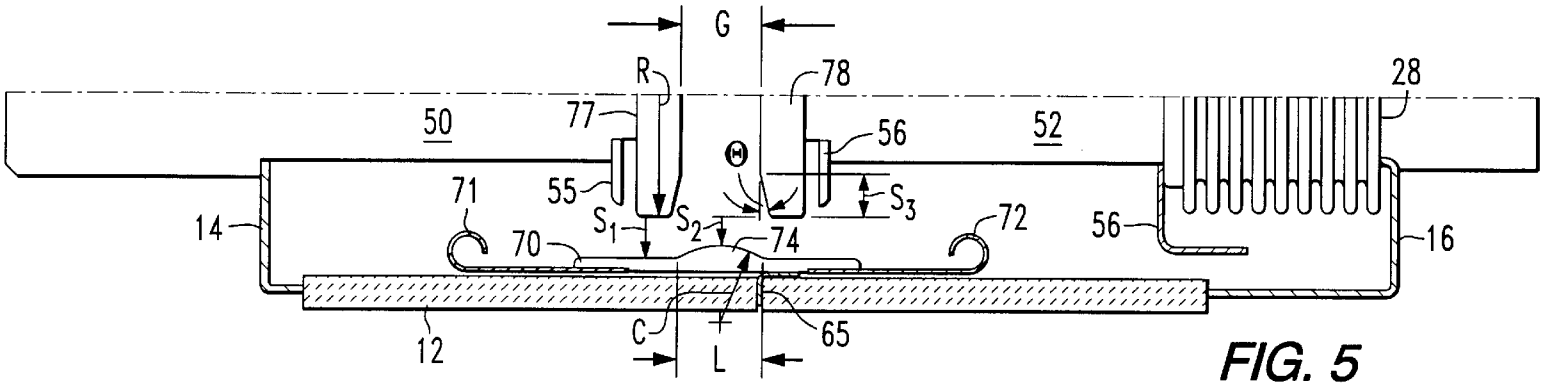
FIG. 5 is a partial sectional view of a vacuum interrupter including a vapor shield in accordance with another embodiment of the present invention.

FIG. 5 shows another embodiment of the present invention similar to that of FIG. 4 in which the mid portion 70 of the vapor shield is made from a thicker cylinder of material, such as described in U.S. Pat. No. 4,553,007, which is incorporated herein by reference. The end portions 71 and 72 are made of thinner material, such as stainless steel. The annular bump 74 of the inner surface of the shield 70 may be formed by any suitable method such as machining a blank cylinder of the thick material. For high interruption currents, the use of a material of the type described in U.S. Pat. No. 4,553,007 for the annular bump and/or the body of a shield such as shown in the embodiment of FIG. 5 may be desired in order to provide more robustness to the shield.

In addition to metals, the vapor shields 60 and 70 may be made of insulating materials such as ceramics coated with an electrically conductive layer of material at least in the region of the annular bumps 64 and 74. If the vapor shield is completely of an insulating material, a conductive layer can be built up on the bump after assembly of the VI by repeated arcing operations, which will deposit a layer of condensed metal vapor on the surface of the bump.

In the embodiment of the invention shown in FIG. 5, spiral electrode contacts 77 and 78 are employed with disk shaped shields 55 and 56 behind the contacts. One example of a spiral contact configuration is described in U.S. Pat. No. 5,444,201, which is incorporated herein by reference. For spiral contact configurations which provide an azimuthal driving force on the arc column, striking of the running arc on the cylindrical vapor shield during a current interruption operation will not degrade the interruption performance as long as the thickness and material of the vapor shield are chosen to endure the arcing duty. This arc-to-shield effect can improve interruption by forcing the arc to become diffuse more rapidly. With this embodiment, the arc-to-shield effect is enhanced by the bending of the lines of force from the contact edges towards the inwardly extending vapor shield.

The contacts shown in FIGS. 4 and 5 are of a cylindrical configuration, and have an outer radius R. If the two contacts have different outer radii, R refers to the larger of the two. The preferred vapor shield of the present invention includes a substantially cylindrical body portion having an inner main cylinder radius which is greater than R by the radial distance $S_1$ and a radially inwardly extending portion having an inner minimum radius which is greater than R by the radial distance $S_2$. The distance $S_2$ is smaller than the distance $S_1$, as shown in FIGS. 4 and 5. The minimum radial distance $S_2$ defines a plane that is preferably parallel with a mid-plane of the fully open contact gap G. More preferably, the plane defined by the minimum radial distance $S_2$ substantially coincides with the mid-plane of the fully open contact gap G.

Figure 7:
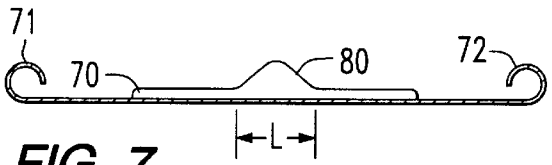
FIG. 7 is a partial sectional view of a vacuum interrupter vapor shield in accordance with another embodiment of the present invention.
Figure 6:
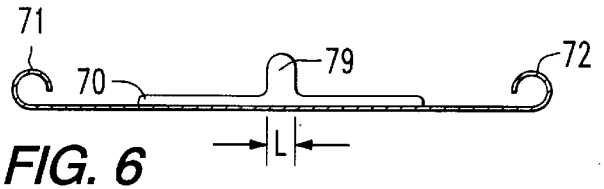
FIG. 6 is a partial sectional view of a vacuum interrupter vapor shield in accordance with another embodiment of the present invention.

In the embodiments shown in FIGS. 4 and 5, the annular bumps 64 and 74 are preferably curved, and have a substantially constant radius of curvature C. Alternative embodiments of the annular bump are also possible. In the embodiment shown in FIG. 6, the annular bump 79 extends radially inward a relatively large distance. In the embodiment of FIG. 7, the annular bump 80 extends radially inward an intermediate distance. The length L of each annular bump 64, 74, 79 and 80 is preferably from about 0.2 to about 2 times the length of the contact gap G. In a particularly preferred embodiment, the annular bump has a substantially constant radius of curvature C and a length L substantially equal to the length of the contact gap G.

Using finite-element calculations of the distribution of equipotentials in the region of the contacts and vapor shield, preferred configurations have been determined by parametric analysis of the geometries. To optimize the benefit of the annular bumps, such as those illustrated in FIGS. 4 and 5, preferably the distance $S_1$ is greater than about one-third of the contact gap G. The annular bumps 64 and 74 preferably extend from the substantially cylindrical body portions 60 and 70 toward the contacts a distance of about one-fifth or more of the shortest radial distance $S_1$ between the cylindrical body portions 60 and 70 and the contacts. The shortest radial distance $S_2$ between the annular bump of the vapor shield and the outer radius R of the contacts is preferably less than the length of the full contact gap G. More preferably, the shortest radial distance $S_2$ is from about one-tenth to about one-half of the length of the contact gap G. Note that the contact faces in FIGS. 4 and 5 have a sloping profile defined by $\theta$ and $S_3$. The preferred radial distances stated here for $S_1$ and $S_2$ remain in effect for $S_3 \leqq R$ and $0 \leqq \theta 90°$.

Figure 8:
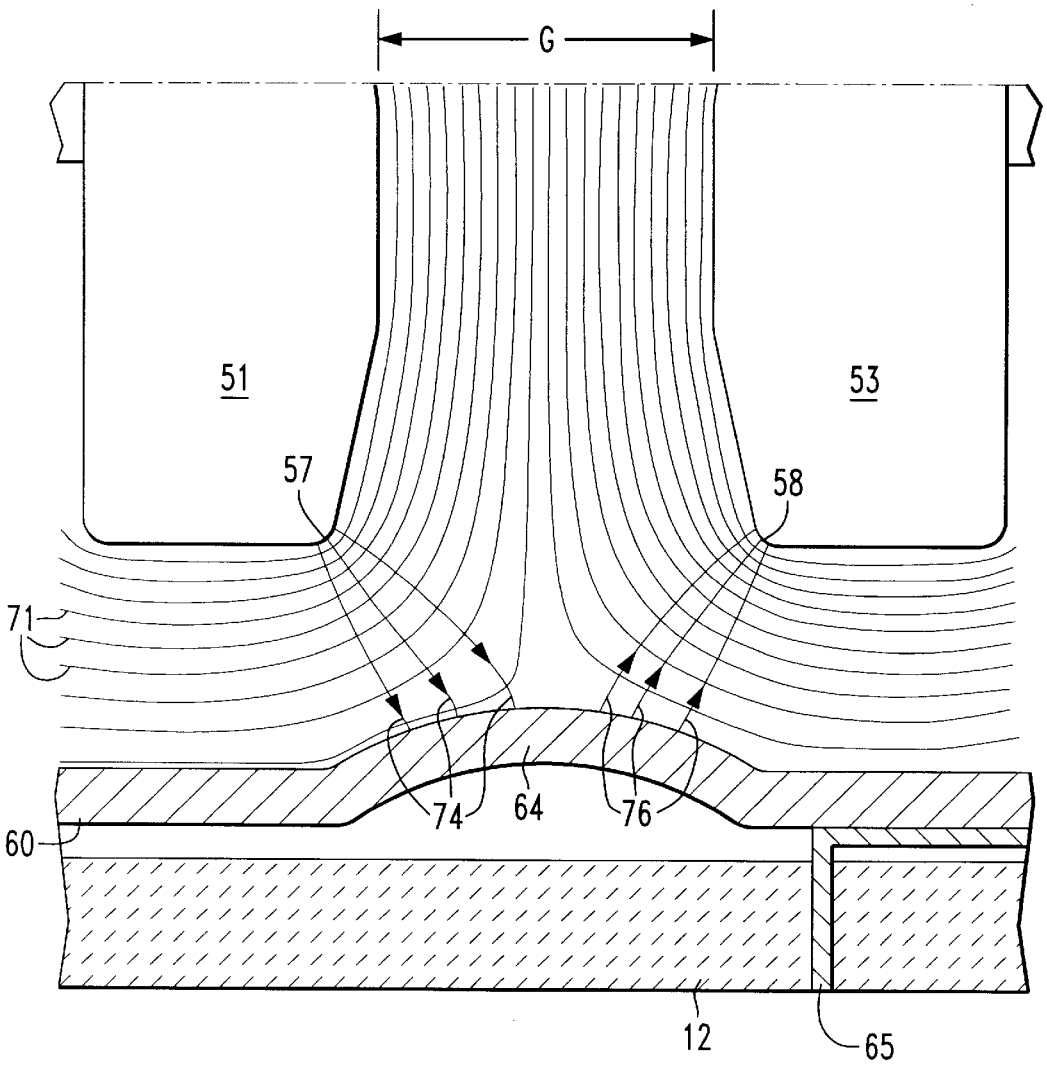
FIG. 8 is an enlarged view of a vacuum interrupter similar to that shown in FIG. 4, illustrating equipotential lines and lines of force running from the cathode to the vapor shield and from the shield to the anode.

FIG. 8 is an enlarged view showing equipotential lines 71 for a VI vapor shield 60 in accordance with an embodiment of the present invention, with lines of force 74 and 76 having endpoints on the corners 57 and 58 of the contacts 51 and 53. The lines of force 74 from the cathode contact 51 diverge toward an area on the shield which is much larger than the emitting region of the corner 57 of the cathode 51. This deflects an electron beam or cathode flare originating from the region 57 away from the anode 53, which suppresses the production of an anode hot spot or anode flare. At the same time, the inner surface of the annular bump 64 on vapor shield 60 is preferably kept far enough from the corners 57 and 58 of the contacts so that any additional electric stress on the corners 57 and 58 due to the presence of the annular bump 64 is not so high as to cause any significant increase in explosive electron emission. This allows the VI to achieve an improved high voltage withstand ability.

The specifications of the vapor shield of this invention are not dependent on the particular style of contacts used in the vacuum interrupter. Examples of other common contact styles which can be employed with this vapor shield are substantially cylindrical or cup-shaped contact assemblies which are designed to produce either a substantially axially or radially directed magnetic field in the region of the contact gap. Examples of these types of contacts are described in U.S. patent application Ser. No. 08/488,401, which is incorporated herein by reference.

In accordance with the present invention, the shape and dimensions of the vacuum interrupter vapor shield are controlled in order to reduce basic impulse level breakdown of the vacuum interrupter when its electrodes are in the rated fully separated position. The extended portion or annular bump of the vapor shield is preferably shaped to direct electron beams from the facing corner region of one of the electrodes to the vapor shield and away from the other electrode. The extended portion preferably defuses the electron beams directed from one electrode to the vapor shield, and reduces breakdowns due to explosive electron emissions from the electrodes.

Whereas particular embodiments of this invention have been described above for purposes of illustration, it will be evident to those skilled in the art that numerous variations of the details of the present invention may be made without departing from the invention as defined in the appended claims.

What is claimed is:

1. A vacuum interrupter comprising:

a sealed vacuum envelope comprising a substantially cylindrical electrically insulating section;

electrode assemblies comprising contacts inside the electrically insulating section of the vacuum envelope which are separable to form a contact gap; and a vapor shield between the electrically insulating section of the vacuum envelope and the contacts, the vapor shield including a conductive extended portion adjacent the contact gap extending in a radial direction from the electrically insulating section of the vacuum envelope toward the contact gap, wherein the vapor shield is electrically isolated from at least one of the contacts when the contacts are in an open circuit position and a shortest radial distance from the conductive extended portion to the contacts is less than or equal to a length of the contact gap.

2. The vacuum interrupter of claim 1, wherein the electrically insulating portion of the vapor shield coaxially surrounds the contacts and comprises a substantially cylindrical body portion having an inner main cylinder radius, and the extended portion has an inner minimum radius smaller than the main cylinder radius.

3. The vacuum interrupter of claim 2, wherein the minimum radius of the extended portion defines a plane that is substantially parallel with a midplane of the contact gap.

4. The vacuum interrupter of claim 3, wherein the plane defined by the minimum radius substantially coincides with the midplane of the contact gap.

5. The vacuum interrupter of claim 2, wherein the extended portion defines a bump which extends radially inward from the main cylinder radius to the minimum radius.

6. The vacuum interrupter of claim 5, wherein the bump is at least partially curved.

7. The vacuum interrupter of claim 6, wherein the bump has a substantially constant radius of curvature.

8. The vacuum interrupter of claim 5, wherein the bump has a length of from about 0.2 to about 2 times a length of the contact gap.

9. The vacuum interrupter of claim 5, wherein the bump has a length substantially equal to a length of the contact gap.

10. The vacuum interrupter of claim 2, further comprising:

at least one rim extending radially inward from at least one end of the substantially cylindrical body.

11. The vacuum interrupter of claim 2, wherein the vapor shield is fabricated from a single piece of material.

12. The vacuum interrupter of claim 2, wherein at least one end of the vapor shield is fabricated from a different piece of material than the body portion.

13. The vacuum interrupter of claim 1, wherein the shortest radial distance from the extended portion to the contacts is from about 0.25 to about 0.5 times the length of the contact gap.

14. The vacuum interrupter of claim 1, wherein the extended portion extends from the substantially cylindrical body portion toward the contacts a distance of about one-fifth or more of the shortest radial distance between the cylindrical body portion and the contacts, and the shortest radial distance between the contacts and the cylindrical body portion is greater than about one-third of the length of the contact gap.

15. The vacuum interrupter of claim 1, wherein the extended portion is shaped to increase an average basic impulse level voltage withstand ability of the contacts in the open circuit position.

16. The vacuum interrupter of claim 1, wherein the extended portion is shaped to direct electron beams from a facing corner region of at least one of the contacts to the vapor shield and away from an other contact.

17. The vacuum interrupter of claim 16, wherein the extended portion is shaped to diffuse the electron beams directed from a facing corner region of at least one of the contacts to the vapor shield.

* * * * *